US006328432B1

(12) United States Patent
Oota

(10) Patent No.: US 6,328,432 B1
(45) **Date of Patent: *Dec. 11, 2001**

(54) INK JET RECORDING HEAD HAVING MENDING LAYERS BETWEEN SIDE WALLS AND ELECTRODES

(75) Inventor: Takashi Oota, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,577

(22) Filed: Jun. 23, 1998

(30) Foreign Application Priority Data

Jun. 25, 1997 (JP) ..... 9-167808

(51) Int. Cl.[7] ..... B41J 2/045
(52) U.S. Cl. ..... 347/68; 347/64
(58) Field of Search ..... 347/69, 71, 68, 347/64

(56) References Cited

U.S. PATENT DOCUMENTS 5,677,717 * 10/1997 Ohashi ..... 347/69
5,719,606 * 2/1998 Kigawa et al. ..... 347/69

FOREIGN PATENT DOCUMENTS 0 612 619 A1 8/1994 (EP) .
0 768 181 A1 4/1997 (EP) .
Sho 63-65686 3/1988 (JP) .
Hei 4-206870 7/1992 (JP) .
Hei 4-263955 9/1992 (JP) .
Hei 6-20866 1/1994 (JP) .
6-246913 9/1994 (JP) .
10-93153 4/1998 (JP) .
10-119264 5/1998 (JP) .

OTHER PUBLICATIONS

Kiyomitsu, S., "Manufacture of Ink Jet Head," *Patent Abstracts of Japan*, Oct. 31, 1997.
Yumiko, O., "Ink Jet Printer Head," *Patent Abstracts of Japan*, Nov. 15, 1994.
English translation of Japanese Office Action dated Mar. 16, 1999 (Hei 11).
Japanese Office Action, dated Nov. 17, 1998, with English language translation of Japanese Examiner's comments.

* cited by examiner

*Primary Examiner*—Benjamin R. Fuller
*Assistant Examiner*—C. Dickens
(74) *Attorney, Agent, or Firm*—Whitham, Curtis & Christofferson

(57) ABSTRACT

In an ink jet recording head having a structure wherein grooves are formed on a piezo-electric ceramic substrate by a cutting work and the resulting side walls of the grooves are driven to thereby jet each ink in the grooves, fine cracks appears in the surface layer portion of the side wall during the time of the cutting work, accordingly the strength of the side walls is reduced, a long time driving of the side walls develops the cracks to end in the destruction and so on, which causes a problem of the reliability to be overcome. The cracks occurred in the surface layer portion of the side walls 4 are penetrated by an oxide 5 for being mended. The piezo-electric ceramic substrate with the grooves is coated with a solution obtained by solving the constituent elements of the oxide into a solvent and is fired so that the side walls are reinforced.

3 Claims, 4 Drawing Sheets

INK JET RECORDING HEAD HAVING MENDING LAYERS BETWEEN SIDE WALLS AND ELECTRODES

BACKGROUND OF THE INVENTION

1. Field of the Invention:

The present invention relates to an ink jet recording head having grooves of ink flowing paths and a method of production thereof, more particularly, it relates to an ink jet recording head and a method of production thereof which are applied to a printer, and a duplicating machine, etc.

2. Description of the Related Art:

A conventional ink jet recording head is described in Japanese Laid-Open Patent Publication No. 6-246913 published on Sep. 6, 1994. Referring to FIG. 5, the conventional ink jet recording head is explained. This figure is a cross sectional view illustrating the structure of the conventional ink jet recording head. The head as illustrated in the figure has a structure in which a piezo-electric ceramic element 11 provided with a plurality of grooves 22 and subjected to a polarization treatment in the direction of an arrow 14 is bonded, through a bonding layer 13 of an epoxy based adhesive, to a cover plate 12 of a ceramic material or a resinous material and so on. According to the above constitution, a plurality of the grooves 22 are formed for serving as ink flowing paths. Each ink flowing path is long and narrow in shape and oblong in a cross section, and a side wall 21 is extended over a whole length of the ink flowing path.

An metal electrode 23 for generating a driving electric field is formed on both of the side surfaces of the side wall 21, ranging from the upper portion of the side wall 21 near the adhesion layer 13 on the top of the side wall 21 to the middle portion thereof. Also, a protective layer 30 is formed for covering the electrode 23. Every ink flowing path is filled with ink.

Next, a method of producing the conventional head will be explained. First, the piezo-electric ceramic element 11 is provided with a groove 22 by a cutting work utilizing a thin disk-shaped diamond blade. The metal electrode 23 is formed on an inner side wall of the groove by a sputtering method and so on. Further, the protective film 30 is so made on the inner wall of the groove 22 as to cover the electrode 23.

In a ink jet recording head having such a structure, at the time of being driven, the metal electrodes 23*d* and 23*g* are ground and a positive voltage is applied to the metal electrodes 23*e* and 23*f*. Then, the direction of an electric field generated by the application of the voltage and the direction of a polarization thereby in each of the side walls 21*b* and 21*c* are positioned rectangularly with each other. Accordingly, the side walls 21*b* and 21*c* are deformed each toward the inside of the groove 22*b* through a piezo-electric thickness slide effect. As a result, the ink within the groove 22*b* is pressurized so that the ink is jetted from a nozzle not shown in any figures.

There are the following problems in an ink jet recording head having such a structure that some grooves are formed on a piezo-electric element by a cutting work and the resulting side walls of the grooves are driven to thereby jet each ink in the grooves.

That is to say, the strength of the side wall is weak because fine cracks are produced in the outer surface of the side wall of the groove by a cutting work, and the cracks are developed further to ends in destroying the side wall or causing the like while the side wall is driven for a long time, which brings a problem in reliability. On the other hand, if a width of the side wall is enlarged in order to reduce the bad influence attributable to the cracks, an interval between the grooves becomes so large as not to allow the nozzles connected the grooves to be disposed in high density.

In another aspect, there is a large surface roughness in the side wall surface which is a surface obtained by subjecting a piezo-electric ceramic substrate to a cutting work. Therefore, the convex portions in the side wall surface are coated with the electrode material and the protective film, however, the concave portions therein have the difficulty to be coated therewith. If the electrode does not contact sufficiently with a piezo-electric ceramic substrate, it decreases an amount of deformation of the side wall. In the case that a coating of the protective film is insufficient, an insulation resistance of the protective film is so lowered as to bring about such defects as an electric current leak into ink and a corrosion of the electrode.

The invention is made to overcome the above disadvantages of the prior art, the object of the present invention is to provide an ink jet recording head in which the strength of the side wall is high and a surface roughness of the side wall is small, and a method of producing the same.

SUMMARY OF THE INVENTION

An ink jet recording head of the present invention is such an ink jet recording head wherein a voltage is applied to an electrode formed on the side wall of a groove provided in a piezo-electric ceramic substrate to thereby jet the ink filled into the groove, and it comprises, as a feature, a mending film interposed on the side wall for mending the irregularities of the side wall.

A method of producing an ink jet recording head according to the present invention is such a method as to produce an ink jet recording head wherein a voltage is applied to an electrode formed on the side wall of a groove provided in a piezo-electric ceramic substrate to thereby jet the ink filled into the groove, and the method comprises, as a feature, a groove formation step of providing a groove in the piezo-electric ceramic substrate and a mending film formation step of providing a mending film on the side wall surface for mending the irregularities thereof.

The mending film has such a feature that it is of an oxide material. The oxide material is characterized in that it is of a lead-zirconium-titanium based oxide, for example.

In short, according to the present invention, there is formed on the side wall surface of the groove a mending film for mending the irregularities which appears on the side wall surface when the grooves are formed for an ink jet recording head. By providing the mending film, the strength of the side wall is largely improved and the cover ability of each of the electrode and the protective film is also made better. The improved coverability of each of the electrode and the protective film prevents a leak of current to thereby raise the reliability.

DETAILED DESCRIPTION OF THE PREFERRED EMBODIMENTS

Figure 1:
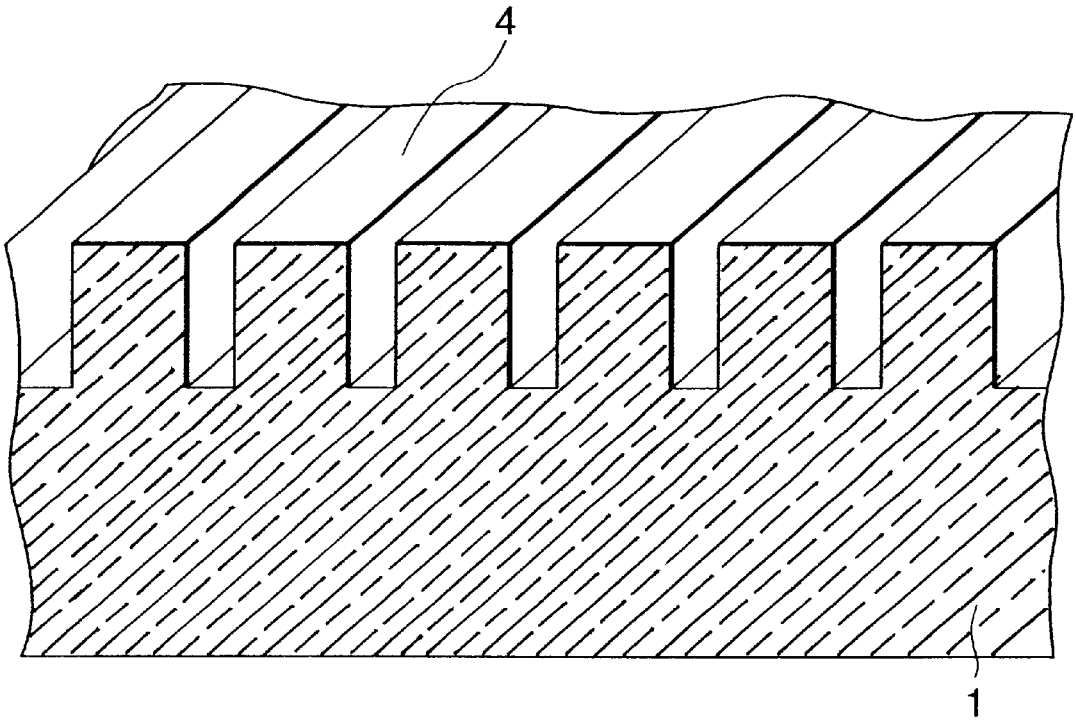
FIG. 1 is a fragmentary perspective view of a piezo-electric ceramic substrate of an ink jet recording head according to an embodiment of the present invention.

Next, referring to the drawings, an embodiment of the present invention will be explained.

Figure 2:
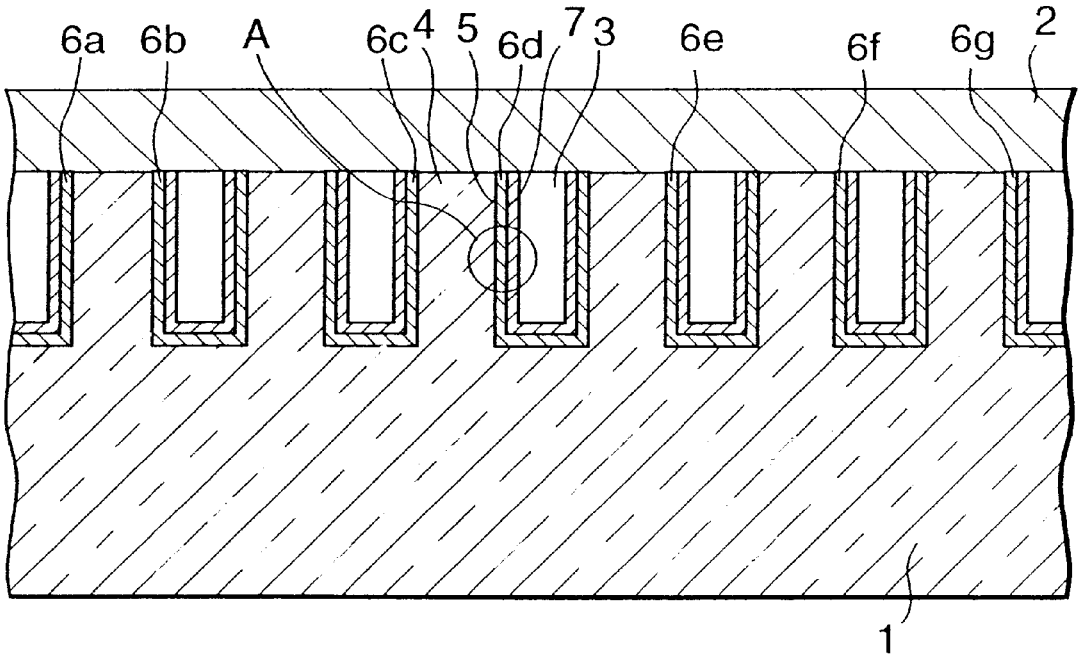
FIG. 2 is a cross sectional view illustrating a structure of an ink jet recording head according to the embodiment of the present invention.

FIG. 1 is a fragmentary perspective view of a piezo-electric ceramic substrate of an ink jet recording head according to an embodiment of the present invention, and FIG. 2 is a cross sectional view illustrating a structure of the ink jet recording head of the embodiment. The ink jet recording head has a structure in which a plurality of ink flowing paths are defined by a bonding between a piezo-electric ceramic substrate 1 with a plurality of grooves and a top plate 2. Each of the ink flowing paths is formed between the side walls 4. The ink flowing paths are individually connected to nozzles (not illustrated).

Figure 3:
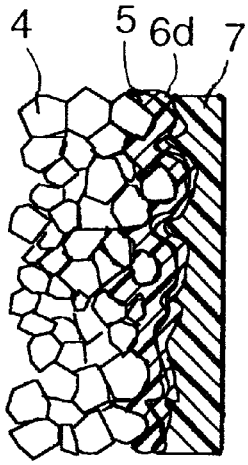
FIG. 3 is a enlarged view of the A section in FIG. 2.

In FIG. 3, an enlarged view of the A section (in FIG. 2) of the side wall is shown. The side wall 4 of piezo-electric ceramics is of a polycrystalline body obtained by aggregating crystal grains of several microns in size. The irregularities and cracks, etc. appear in the surface of the side wall 4 when the grooves are formed, however, these irregularities are mended by applying an oxide 5 material to the side wall. Then, an electrode 6*d* is formed on the oxide 5 and subsequently a protective film 7 is provided thereto. In FIG. 2, electrodes 6*a* to 6*g* are formed in each ink flowing path.

The oxide 5 is formed in such a way that the piezo-electric ceramic substrate with a plurality of grooves is coated with a solution obtained by solving the constituent elements of the oxide into a solvent and thereafter is fired.

In such a structure, the side wall 4 is deformed by applying a voltage to the electrodes sandwiching the side wall so that the ink flowing path is pressurized to jet the ink. For example, a voltage is supplied between the electrodes 6*c*, 6*d* and 6*d*, 6*e* to eject the ink from the ink flowing path having the electrode 6*d*.

Although the irregularities and cracks have occurred in the side wall due to a cutting work for forming the grooves therein, the oxide material penetrates into the cracks to solidify thereabout and resultingly reinforces the side wall. Further, the irregularities on the side wall surface are absorbed into the oxide 5 so that it improves the adhesiveness and the coverability of each of the electrode and the protective film to thereby raise the reliability.

EXAMPLE

Referring to FIG. 2 and FIG. 3, the grooves each having a width of 60 $\mu$m and a depth of 200 $\mu$m are formed in the piezo-electric ceramic substrate at equal intervals of 127 $\mu$m, the top plate 2 of polyimide with a thickness of 75 $\mu$m is bonded onto these grooves.

Referring to FIG. 3 which is an enlarged view showing the A section in the side wall 4 of the groove, the side wall 4 of the piezo-electric ceramics substrate is made of a polycrystalline body resulted from that crystal grains, each having several $\mu$m in size, are aggregated. The surface layer portion of the side wall 4 is mended by filling the oxide material into the cracks occurred during the time of a cutting work of the grooves. The oxide material 5 penetrates into the cracks in the surface layer portion of the side wall and is bonded firmly to the piezo-electric ceramics substrate 1. Onto the resulting surface, an aluminum alloy electrode 6 is formed with a thickness of 1 $\mu$m, subsequently a silicon oxide 7 is formed thereon.

The grooves 3 are provided by a cutting work using a dicing saw with a diamond blade. In this embodiment, the PZT is used for the oxide material. In this case, the piezo-electric ceramic substrate with the grooves is coated, by a spin coating method (using a spinner), with an aqueous solution obtained by dissolving Pb (lead), Zr (zirconium) and Ti (titanium) being the constituent elements of the PZT into a solution of lead acetate and chloride and then is fired at 800° C. After that, an aluminum alloy material for an electrode 6 is formed as a film through a sputtering method. A silicon oxide for a protective film 7 is made as a film by a CVD (Chemical Vapor Deposition) method.

Figure 4:
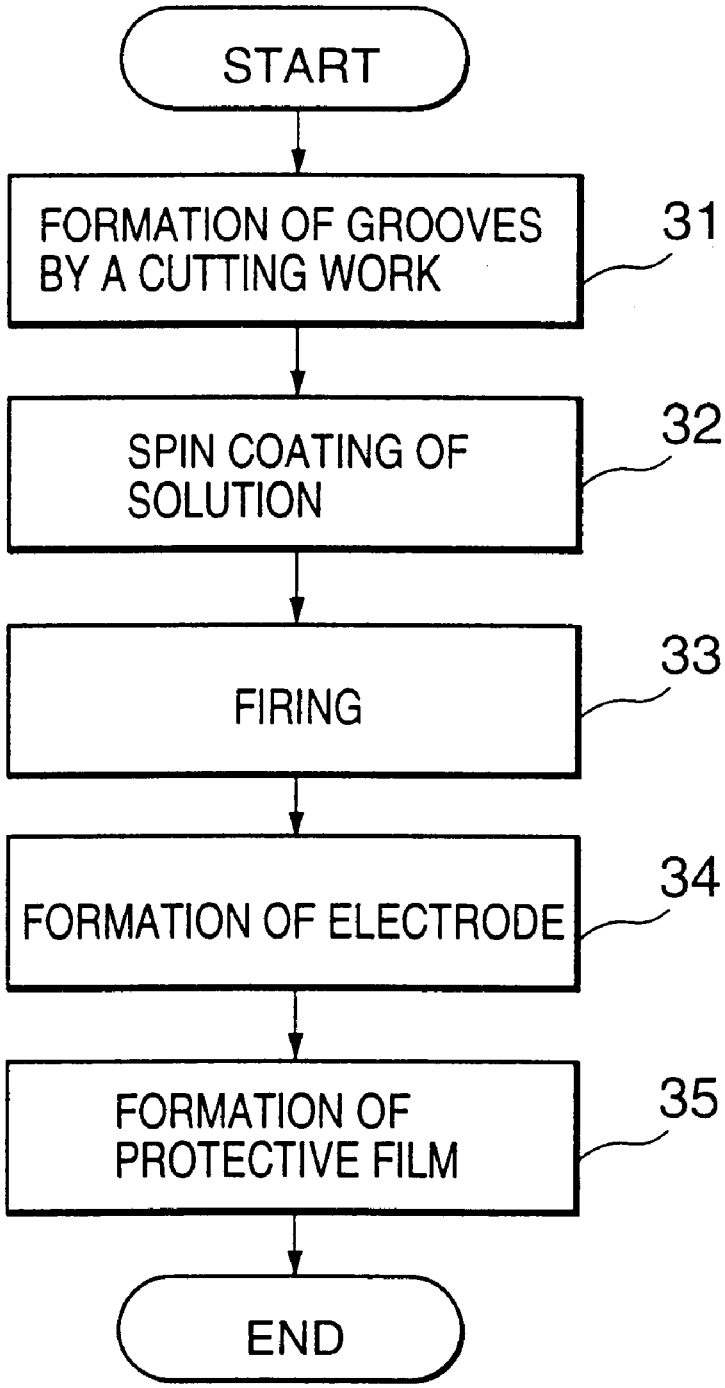
FIG. 4 is a flow chart illustrating a producing method of the ink jet recording head in FIG. 2.
Figure 5:
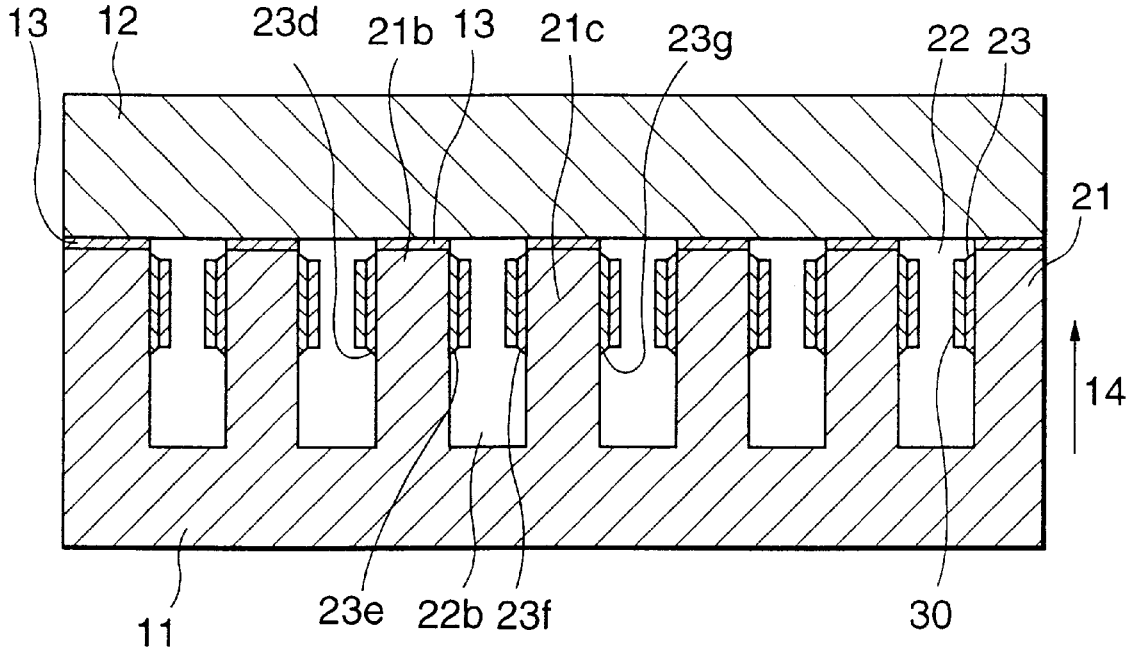
FIG. 5 PRIOR ART
FIG. 5 is a cross sectional view illustrating a structure of an conventional ink jet recording head.

Subsequently, referring to FIG. 4, a producing method of the ink jet recording head will be described. The figure depicts a flow chart showing a producing method of the ink jet recording head in FIG. 2. In the figure, the grooves are provided in the piezo-electric ceramics substrate by a cutting work using the dicing saw (Step 31). After the grooves are formed, the aqueous solution of lead acetate with the constituent elements of the PZT of Pb, Zr and Ti is applied to the piezo-electric ceramic substrate by a spin coating method. (Step 32). Following this coating, it is fired at 800° C. (Step 33).

After this firing, an aluminum alloy is formed as a film by a sputtering method to thereby produce the electrode (Step 34). Subsequently to the electrode formation, a protective film of silicon oxide is provided as a film by a CVD method (Step 35).

At the outcome of the above-mentioned producing steps, the ink jet recording head depicted in FIG. 2 and FIG. 3 is obtained.

At the time of being driven, a voltage is applied between the electrodes on the side wall. Then, the side wall is deformed to pressurize the ink flowing path and enabled to jet the ink.

The cracks have occurred on the side wall due to the cutting work for a formation of the grooves, however, the solution containing the constituent elements of an oxide such as the PZT etc. penetrates into the cracks and solidifies to reinforce the side wall 4. Further, since the irregularities in the side wall surface are absorbed into the oxide material so that the adhesiveness and coverability of each of the electrode and the protective film are improved and resultingly the reliability is raised.

As described above, the present invention is useful for an ink jet recording head having such a structure that a piezo-electric ceramics substrate is provided with grooves and the side walls of which are so driven as to jet each ink in the grooves. The present invention may be applied to an ink jet recording head utilizing such a deformation of the side wall as a piezo-electric thickness slip deformation which is caused when the directions of polarization and electric field are rectangular with each other, a expansion and contraction deformation in the case that the above directions are the same and the like deformation.

As mentioned above, by causing an aqueous solution containing the constituent elements of an oxide to penetrate into the cracks which is caused when the grooves are formed and to solidify as the oxide due to a heat treatment, the strength of the side walls are largely increased and the reliability is raised. Also, because the irregularities of the side wall is absorbed, the coverability of each of the electrode and the protective film is improved and it leads to prevent an electric leak and thereby raise the reliability.

As the above, in the ink jet recording head of the present invention, there are provided the mending film on the side wall surface for mending the irregularities of the side wall of the groove which are caused by the formation of the grooves. As the mending film, the perovskite structure oxide is used. In the embodiment, the lead-zirconium-titanium (PZT) is utilized.

Needless to say, even when the oxides of other perovskite crystal structures are used, the like advantages are obtained. For example, barium titanate ($BaTiO_3$), lead titanate (PbTiO3) and strontium titanate ($SrTiO_3$) are available.

As mentioned above, in the present invention, there is formed on the side wall surface of the groove the mending film for mending the irregularities which are caused on the side wall surface when the grooves of an ink jet recording head is formed, accordingly, it brings about such advantages that the strength of the side wall is largely reinforced and the coverability of each of the electrode and the protective film is also improved. Further, it provides another advantage that any electric leak never happens and the reliability is raised because the coverability of each of the electrode and the protective film is improved.

What is claimed is:

1. An ink jet recording head, comprising:

a piezo-electric ceramic substrate having a plurality of grooves, each of said grooves including a base and side walls which are made of piezo-electric ceramic;

a mending layer penetrating into cracks of said side walls to solidify thereabout, for mending irregularities of surfaces of said side walls; and a plurality of electrodes formed on surfaces mended by said mending layer of said side walls, voltages being applied to said plurality of electrodes to eject ink filled in said grooves.

2. An ink jet recording head according to claim 1, wherein said mending layer is made of an oxide material having the perovskite crystal structure.

3. An ink jet recording head according to claim 2, wherein the oxide material is of a lead-zirconium-titanium based oxide.

* * * * *